United States Patent [19]

Berggren

[11] 3,961,757

[45] June 8, 1976

[54] METHOD AND MACHINE FOR REFINING WOOD CHIPPINGS, SHAVINGS, PAPER PULP AND THE LIKE

[75] Inventor: Torsten Lennart Berggren, Nassjo, Sweden

[73] Assignee: Cellwood Machinery AB, Nassjo, Sweden

[22] Filed: Apr. 2, 1975

[21] Appl. No.: 564,337

[52] U.S. Cl. ..... 241/28; 241/37
[51] Int. Cl.[2] ..... B27L 11/08
[58] Field of Search ..... 241/28, 30, 37

[56] References Cited

UNITED STATES PATENTS

| | | | |
|---|---|---|---|
| 2,947,485 | 8/1960 | Woodruff et al. | 241/37 |
| 2,971,704 | 2/1961 | Johansson | 241/37 |
| 3,799,456 | 3/1974 | Jewell et al. | 241/37 |

*Primary Examiner*—Granville Y. Custer, Jr.
*Attorney, Agent, or Firm*—Flynn and Frishauf

[57] ABSTRACT

Refining machine for chippings, shavings, paper pulp and the like comprising two grinding discs rotatable relative to one another and each provided with grinding bodies, forming between them a narrow slot-shaped grinding chamber. The grinding discs are so arranged that they can be displaced relative to one another for the adjustment of the size of the slot-shaped grinding chamber in order to compensate for the wear of the grinding bodies. Means is provided to cause the grinding discs to approach one another continuously at a predetermined rate during the period the machine is in operation.

19 Claims, 1 Drawing Figure

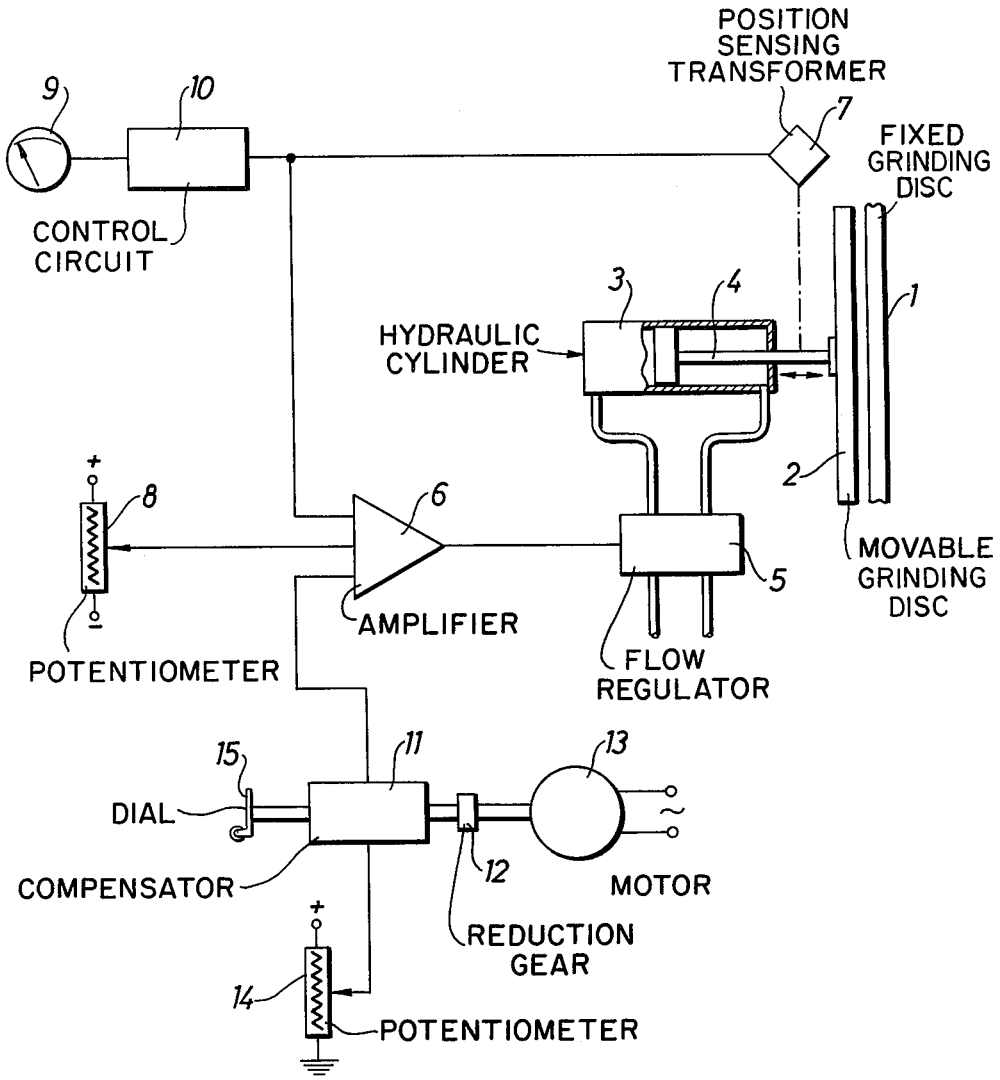
POSITION
SENSING
TRANSFORMER
7
9
10
FIXED
GRINDING
DISC
CONTROL
CIRCUIT
3
4
1
HYDRAULIC
CYLINDER
2
8
6
5
MOVABLE
GRINDING
DISC
AMPLIFIER
POTENTIOMETER
FLOW
REGULATOR
15
11
13
DIAL
12
COMPENSATOR
MOTOR
REDUCTION
GEAR
14
POTENTIOMETER

METHOD AND MACHINE FOR REFINING WOOD CHIPPINGS, SHAVINGS, PAPER PULP AND THE LIKE

The present invention relates to a method and apparatus for refining wood chippings, shavings as well as paper pulps in higher non-pumpable concentrations by the use of a refining machine comprising two disc-shaped grinding means (hereinafter referred to as "grinding discs") rotatable relative to one another and each provided with grinding bodies, forming between them a narrow, slot-shaped grinding chamber. The grinding discs are so arranged that they are displaceable towards and away from one another for adjustment of the size of the slot-shaped grinding chamber in order to compensate for the wear of the grinding bodies.

Refining machines of this kind, an advantageous design for which is described in copending U.S. Pat. application Ser. No. 412,464, filed Nov. 2, 1973, assigned to the same Assignee as the present application, have for several decades been employed in, inter alia, paper manufacture. Although during this period the refining machines have undergone constant development to improve their performance as to quality, quantity, reliability, etc., the known refining machines suffer from the common disadvantage that the quality of the refined material or the degree of refinement varies in the course of time. This is because the grinding bodies of the grinding discs wear during use, so that the distance between them increases. To compensate for this, the refining machines have for a long time been provided with manually activated adjustment devices for intermittent adjustment of the relative position of the grinding discs. Adjustment has usually been effected by means of screws or by electro-hydraulic means. At best, adjustment has resulted in optimum refining being obtained immediately after effecting the adjustment operation, which then, however, deteriorates until the next adjustment. The degrees of refinement will thus vary in the form of a saw-tooth-shaped curve.

These manual adjustments, which have until now — although their imperfection was well-known — been considered the only possible practical way of compensating for wear on the grinding bodies, have also led to other problems and risks. Among other things, an adjustment can be neglected or be too small, resulting in poor quality of the refined material. Alternatively, too large an adjustment can be made causing a metallic contact between the grinding bodies, which can lead to mechanical break-down. To reduce these risks and to achieve refining results as good as possible, it has been necessary to make high demands on the accuracy and professional skill of the operator.

The main objects of the present invention are to achieve a method of and a machine for refining which provides a uniform and high quality of the refined material, and in which all of the above disadvantages are eliminated.

Summary of the Invention

According to the invention these objects are obtained by effecting the adjustment of the size of the grinding slot by displacing the grinding discs relative to each other continuously at a predetermined rate during the period the machine is in operation.

Brief Description of the Drawing

The invention will be described in greater detail below with reference to the embodiment shown diagrammatically in the accompanying drawing of a control system according to the invention.

Detailed Description of Illustrated Embodiment

Reference numeral 1 designates a fixed grinding disc of a refining machine and reference numeral 2 a corresponding movable grinding disc. The grinding discs are shown only diagrammatically, and can in practice comprise two flat ring-shaped members forming a narrow grinding slot between them. The movable grinding disc 2 is displaceable in relation to grinding disc 1 by means of a piston 4 in an hydraulic cylinder 3. The position of the piston 4 in the cylinder 3 is controlled by a flow-regulating servo-valve 5, which is actuated by an electrical signal received from an amplifier 6. The valve 5 is so designed that it allows a fluid flow proportional to the signal from the amplifier 6 to pass to one side of the piston, the other side of the piston being connected to a collecting vessel (not shown).

The grinding discs 1 and 2 are provided on their facing surfaces with grinding bodies, which can have the form of bars or ribs extending in various directions, so that to obtain the desired quality of the material processed between the grinding discs it is very important to keep constant at a certain pre-determined value the distance between the grinding bodies of the two grinding discs, in spite of their becoming worn.

For adjustment of the desired initial distance when fitting new grinding discs, for which the height of the said grinding bodies is known, the position of the grinding disc 2 relative to the fixed grinding disc is sensed, for example by means of a differential transformer 7, and this value is compared in the amplifier 6 with a predetermined desired value set by a potentiometer 8. At the output of the amplifier 6, an amplified difference signal is generated which actuates the servo-valve 5 in such a direction to move piston 4 so that the actual position value of piston 4 as sensed by the transformer 7 is made to correspond to the predetermined desired value as set on the potentiometer 8. The signal received from the transformer 7 can be supplied via a control circuit 10 to an instrument 9, such as a meter, to indicate the size of the slot between the grinding discs 1 and 2.

To compensate for the progressively increasing distance between the grinding bodies caused by wear, the control system described above has been supplemented, according to the present invention, by a compensating circuit which includes a compensator 11, for example in the form of a potentiometer, which, via a reduction gear 12, is driven by a synchronous motor 13. The total voltage applied across the potentiometer 11 is set by means of a potentiometer 14. The movable terminal contact on the potentiometer 11 is connected to an input of the amplifier 6. To read the rotation of the potentiometer 11 and to reset it, a wheel 15 provided with a dial is connected to the shaft of the potentiometer.

The function of this circuit is as follows. The reduction gear 12 is so calculated that it gives a rotation to potentiometer 11 corresponding to minimum wear. If therefore it is assumed that, with minimum wear, the same grinding discs can be retained for six months, the reduction must be so selected that the potentiometer runs through one cycle during this period of time.

By means of potentiometer 14, the output signal gradient, voltage/unit of time, is set that corresponds to the expected wear for the relevant application. Alternatively, the voltage across potentiometer 11 can be kept constant and the rotational speed of the potentiometer set in dependence upon the rate of wear. A combination of these methods is also feasible, but from a practical aspect it is however most suitable for the rotational speed to be kept constant and for the voltage across potentiometer 11 to be altered. The output signal from potentiometer 11 will have, in the case described, the form of an inclined or ramp function, which is added to the other signals supplied to the amplifier. As compensation for wear of the grinding bodies begins to have an effect, the difference between the voltages received from transformer 7 and from potentiometer 8 will increase and balance the increasing voltage received from potentiometer 11. This results in the output signal from the amplifier 6 becoming substantially constant and so setting the valve 5 such that a flow fluid corresponding to the balancing value set on potentiometer 14 is supplied to the pressure side of the piston 4. This results in grinding disc 2 continuously drawing closer to grinding disc 1, this movement wholly corresponding to the wear of the grinding bodies known from experience and set on potentiometer 14.

When using a compensating circuit according to the above in connection with the refinement of material, for which the rate of wear is unknown, the compensation conditions can be established quite simply by a short test run with a "safe" value for the rate of wear, and after this test period the wear concerned can be measured and the correct value set on potentiometer 14. In certain cases, the test run can be divided into several periods for a progressive approach of setting to the correct value.

When replacing the grinding discs or changing the rate of wear, the position-giving differential transformer 7 is reset, and also the compensator 11, by means of the wheel 15. The synchronous motor 13 is connected to the driving motor of the refining machine, so that the compensator is only connected during the periods the refining machine is in operation. For exact reading of the compensation introduced, the position of wheel 15 should be determined in the light of the voltage set on potentiometer 14.

The control system described above should be regarded only as an example of one system according to the invention, which can be varied in a number of ways within the framework of the claims. If, for example, wear which is not time-linear is to be compensated, potentiometer 11 can be replaced by another suitable device whose output signal has a form corresponding to the actual wear. For this purpose, the potentiometer 11 could perhaps be run at a varying speed.

I claim:

1. Method of refining wood chippings, shavings, paper pulp in high non-pumpable concentrations and the like by use of a refining machine which includes two relatively displaceable grinding devices which are rotatable relative to one another and which are each provided with grinding bodies thereon, the method comprising:

arranging said grinding devices to form a narrow slot-shaped grinding chamber between the grinding bodies of the two grinding devices, said grinding devices being relatively displaceable toward and away from each other so as to vary the size of said slot-shaped grinding chamber; and displacing a grinding device relative to the other as a function of the position thereof relative to the other grinding device and at a predetermined rate during the period of time the machine is in operation, said predetermined rate being independent of the relative positions of the grinding devices, to vary the distance between said grinding devices so as to compensate for wear of said grinding bodies of said grinding devices.

2. Method according to claim 1, wherein said grinding device is displaced continuously so as to maintain the distance between the grinding bodies of said grinding devices substantially constant.

3. Method according to claim 1 wherein said step of continuously displacing a grinding device relative to the other at a predetermined rate comprises sensing the position of said displaceable grinding device and generating a first signal corresponding to the position thereof; generating a second signal corresponding to a desired initial position of the displaceable grinding device; generating a time-varying compensation signal corresponding to a desired additional continuous movement of said displaceable grinding device so as to compensate for wear of said grinding bodies; forming a control signal by subtracting said first signal and said compensation signal from said second signal; and controlling the position of said displaceable grinding device as a function of said control signal.

4. Method according to claim 3 wherein said compensating signal is generated by driving a movable contact of a potentiometer means at a predetermined rate during the period of time the machine is in operaton, said compensation signal being the signal appearing at said movable contact.

5. Method according to claim 1, comprising relatively moving at least one of said grinding devices toward the other according to a time-linear function.

6. Method according to claim 1 comprising continuously displacing a grinding device relative to the other to continuously vary the distance therebetween so as to continuously compensate for wear of said grinding bodies.

7. Machine for refining wood chippings, shavings, paper pulp in high non-pumpable concentrations and the like, comprising:

two grinding devices which are rotatable relative to one another and each of which are provided with grinding bodies, a narrow slot-shaped grinding chamber being formed between the grinding bodies of said grinding devices;

means for displacing said grinding devices relative to one another for adjusting the size of said grinding slot and for compensating for the wear of said grinding bodies; and means coupled to said displacing means for relatively moving said grinding devices toward each other at a predetermined rate during the period of time the machine is in operation to compensate for wear of the grinding bodies by adjusting the spacing between said grinding devices at said predetermined rate, so as to maintain the size of said grinding slot substantially constant.

8. Machine according to claim 7 wherein each of said grinding devices are grinding discs with grinding bodies thereon.

9. Machine according to claim 7 wherein said means coupled to said displacing means for relatively moving said grinding means toward each other includes means for continuously moving said grinding devices toward each other at a predetermined rate to continuously compensate for wear of the grinding bodies.

10. Machine according to claim 7 wherein said displacing means is coupled to one of said grinding devices for displacing said one grinding device relative to the other grinding device so as to adjust the spacing between said grinding device.

11. Machine according to claim 10 wherein said means coupled to said displacing means for relatively moving said grinding devices toward each other comprises means coupled to said displaceable grinding device for sensing the position of said displaceable grinding device and generating a first signal corresponding to the sensed position thereof; means for generating a second signal corresponding to a desired initial position of the displaceable grinding device; compensating means for generating a time-varying compensation signal corresponding to a desired continuous movement of said displaceable grinding device so as to compensate for wear of said grinding bodies; means for subtracting said first signal and said compensation signal from said second signal to develop a control signal; and means coupling said control signal to said displacing means for controlling the displacement position of said displaceable grinding device as a function of said control signal.

12. Machine according to claim 11 wherein said compensating means comprises a potentiometer having a movable contact, means for continuously driving said moving contact of said potentiometer at a predetermined rate during the period of time the machine is in operation, and means for applying a signal to said potentiometer, said compensation signal being the signal appearing at said driven movable contact of said potentiometer.

13. Machine according to claim 12 wherein said means for continuously driving said moving contact of said potentiometer continuously drives same at a predetermined rate which is a function of the rate of wear of the grinding bodies of said grinding devices in a given application.

14. Machine according to claim 12 wherein said means for applying a signal to said potentiometer applies a signal which varies as a function of the rate of wear of the grinding bodies of said grinding devices in a given application.

15. Machine according to claim 10 wherein said displacing means comprises electro-hydraulic means for displacing one of said grinding devices relative to the other, means for generating a first signal representing the actual value of the distance between said grinding devices; means for generating a second signal corresponding to a desired value of the distance between said grinding devices; means for generating a continuously varying compensation signal corresponding to a desired continuous variation of the distance between said grinding devices; and means coupling said signals to said electro-hydraulic means, said signals for continuously varying the distance between said grinding devices as a function of said signals.

16. Machine according to claim 15 wherein said means coupling said signals to said electro-hydraulic means comprises means for subtracting said first signal and said compensation signal from said second signal.

17. Machine according to claim 15 wherein said means for generating a compensation signal comprises a potentiometer having a moving contact, means for continuously driving said moving contact of said potentiometer at a predetermined rate during the period of time the machine is in operation, and means for applying a signal to said potentiometer, said compensation signal being the signal appearing at said driven movable contact of said potentiometer.

18. Machine according to claim 17 wherein said means for continuously driving said moving contact of said potentiometer continuously drives same at a predetermined rate which is a function of the rate of wear of the grinding bodies of said grinding devices in a given application.

19. Machine according to claim 17 wherein said means for applying a signal to said potentiometer applies a signal which varies as a function of the rate of wear of the grinding bodies of said grinding devices in a given application.

* * * * *